US005564139A

United States Patent [19]

Shorr

[11] Patent Number: 5,564,139

[45] Date of Patent: Oct. 15, 1996

[54] DUAL SHOWER HEAD ASSEMBLY

[76] Inventor: Edwin M. Shorr, 1511 Susan Dr., Lansdale, Pa. 19446

[21] Appl. No.: 181,791

[22] Filed: Jan. 18, 1994

Related U.S. Application Data

[63] Continuation-in-part of Ser. No. 954,828, Oct. 1, 1992, abandoned, which is a continuation-in-part of Ser. No. 786,781, Nov. 1, 1991, abandoned.

[51] Int. Cl.[6] ..... A47K 3/22

[52] U.S. Cl. ..... 4/601

[58] Field of Search ..... 4/601

[56] References Cited

U.S. PATENT DOCUMENTS

| | | | |
|---|---|---|---|
| 1,102,736 | 7/1914 | Grabau . | |
| 1,354,838 | 10/1920 | Perkins . | |
| 3,121,235 | 2/1964 | Gellmann | 4/148 |
| 3,822,826 | 7/1974 | Wilson | 239/267 |
| 3,913,839 | 10/1975 | Wilson | 239/267 |
| 3,971,074 | 7/1976 | Yxfeldt | 4/145 |
| 4,865,254 | 9/1989 | Kragle | 239/76 |
| 4,901,927 | 2/1990 | Valdivia | 239/446 |

FOREIGN PATENT DOCUMENTS

| | | |
|---|---|---|
| 21312 | 3/1883 | Germany . |

*Primary Examiner*—Charles E. Phillips
*Attorney, Agent, or Firm*—Joseph W. Molasky & Associates

[57] ABSTRACT

A shower head assembly for simultaneously showering both front and back portions of a person's body without a person receiving the force of the shower spray in the face. The device can be used by both small children and adults due to a unique orientation and separation of the shower heads with respect to an overhead supply line.

17 Claims, 6 Drawing Sheets

DUAL SHOWER HEAD ASSEMBLY

CROSS-REFERENCE TO RELATED APPLICATION

This application is a continuation-in-part application of Ser. No. 07/954,828 filed on Oct. 1, 1992, now abandoned, which in turn is a CIP of Ser. No. 07/786,781, filed on Nov. 1, 1991, now abandoned.

BACKGROUND OF THE INVENTION

The present invention relates in general to the art of fluidics and in particular to a dual shower head design that develops an intersecting spray pattern that is suitable for both adults and small children.

In known prior art patents as exemplified by patents U.S. Pat. No. 3,822,826 to Wilson and U.S. Pat. No. 3,913,839 to Wilson, dual shower heads are disclosed for enabling two persons to shower independently at the same time; in addition, both patents disclose that a single person standing centrally may be showered from each side for more rapid cleansing. However, the above-cited patents do not address themselves to the problem of body and skin chill which is present upon certain areas of the body when a single person is showered by dual shower heads. This problem occurs particularly during months when cool drafts are prevalent in a residential location and is caused by warm water from the shower spray impacting the showerer's body in a localized manner leaving wet areas of the body which are not impacted by the dual shower sprays exposed to cool air. The prior art devices showered both sides of a person's body simultaneously yet were limited by the range of intersection of the shower spray. Thus, tall people were impacted below the chest and below the upper back areas which forced the tall shower user to spin to stay warm while children or other people of small stature could not utilize the prior art devices without being sprayed in the face by the showers since the lowest intersection of the sprays was at or over the diminutive user's head. One solution to the problem of showering tall people was to raise the shower head device above the water supply outlet; however, the device raised above the water supply still could not be used by small people or children without the small user being sprayed in the face. Additionally, raising the shower head device above the water supply line also placed the shower head out of reach of children and adults of small stature thereby preventing them from easily adjusting the shower heads. Another common problem encountered with previous dual shower head devices was due to the manner in which the devices were joined to the wall opposite the water supply. Prior devices utilized friction pads made of hard rubber, neoprene, or the like to frictionally secure the devices against the wall. However, the friction pads were subject to sliding along the wall when the shower heads were adjusted resulting in the device becoming dislodged from the wall during use. Therefore, a need exists for a dual shower head arrangement which is capable of producing a dual shower spray with an intersection as high as about 69 inches and as low as about 20 inches thereby providing a single dual shower device usable by both adults and children, which is securely attached to the walls within a shower stall and which has shower heads positioned within the reach of most shower users.

The present invention provides a device which eliminates uncomfortable and annoying chills that result from the inability of the prior art dual shower assemblies to cover the body with a spray pattern that serves equally well for an adult or child. To develop such a spray herein, the dual heads are separated from one another by a designated range; one shower head is inclined at an acute angle and the second head is directed downwardly in an approximate vertical direction with respect to the horizontal to thus achieve an intersection of shower spray from 69 inches high to 20 inches low thereby allowing both adults and children to avoid chills and yet not be sprayed in the face by water during showering. Additionally, the device is securely affixed to the walls of the shower stall to prevent the device from detaching from the walls during use and is mounted directly to the shower stall water supply line thus positioning the shower heads within reach of most adult device users.

SUMMARY OF THE INVENTION

The dual shower head assembly of the invention is designed to afford a uniform temperature response over a user's body. This is accomplished by developing two spray patterns that may interact at, above or below the neckline whether the user be a tall adult or diminutive person or child. This feature enables persons to shower in relative comfort and without frequent turning especially during the late autumn and winter seasons when drafts are prevalent in a residential structure.

The desired spray pattern of the present invention is derived from a novel orientation of dual projections emanating from a horizontal pressure line where one is oriented downwardly, whereas, the second is acutely inclined to the horizontal. Heads are attached to each projection which are swivable so that they can be adapted for a child or an adult user to cover the anatomy at certain desired locations. In view of this feature, a small child whose height is as small as about 30 inches can easily shower without being struck in the face with the full force of the spray since the low intersection of spray at about 20 inches would impact a child about 30 inches tall below the chin. This eliminates the possibility of choking in the small child, and as a result, showering becomes a happy experience for young children in an age group of two to four years and older. Furthermore, the spray pattern of this invention eliminates chills in an adult up to a height of about 78 inches since the high intersection of spray at about 69 inches would also impact an adult below the chin.

It is therefore an object of this invention to provide a new and improved dual shower head assembly capable of providing dual shower sprays which intersect in the range of about 20 to about 69 inches above the floor of a shower enclosure.

It is also an object of this invention to provide a new and improved dual shower head assembly securely anchored to the shower stall walls which is capable of providing intersecting dual shower sprays and has shower heads positioned for easy adjustment by the assembly user.

DESCRIPTION OF THE PREFERRED EMBODIMENT

Figure 1:
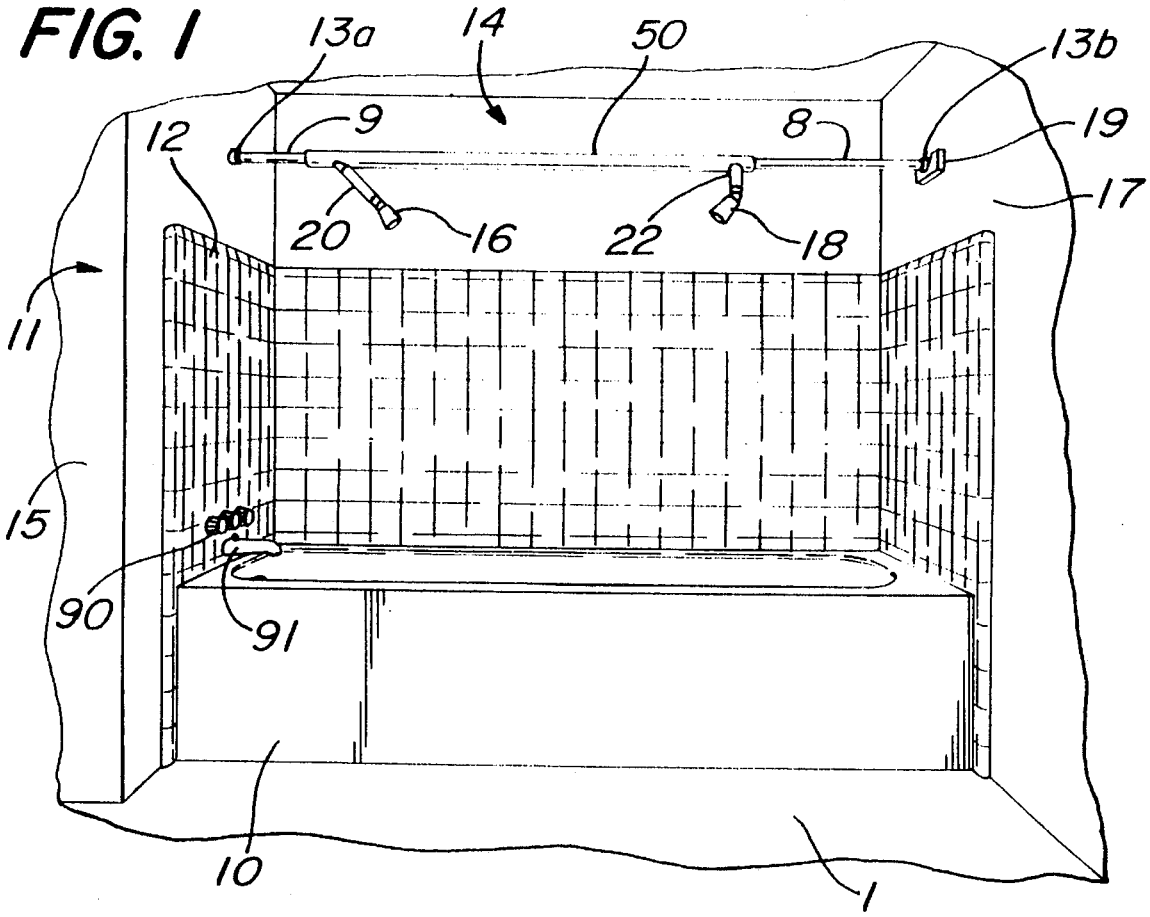
FIG. 1 is a front elevational view of the shower installation of this invention.

Referring now to the drawings and, in particular, to the front elevational view of FIG. 1 there is depicted a bath tub 10 with a dual shower assembly 14 in accordance with the invention. The shower tub 10 is of conventional design, namely approximately five feet in length, and is depicted in an appropriate alcove 11 in which ceramic tile 12 or other appropriate wall covering is provided. Straddling the length of the tub 10 is the shower assembly 14. The assembly 14 comprises a supply line 50 oriented parallel to the shower floor 1 whose proximal end 13*a* (i.e., end nearest the pressurized water source) consists of a nipple 9 which is attached directly to a pressurized water source (not shown) located behind the wall 15; the nipple 9 is threaded at the end 13*a* for connecting to the supply. The distal end 13*b* (i.e., end farthest from the pressurized water source) consists of a slidable shaft for coupling supply line 13 for gravitational resting upon the recessed block 19 which is attached to wall 17 by fastening means (not shown in FIG. 2) such as set screws, bolts, or any other secure fastening means to fix block 19 firmly in place on wall 17. Thus, the assembly is tightly secured within the shower enclosure by being screwed into the pressurized water supply at the proximal end of the assembly and being mounted on block 19 which is securely attached to the wall 17 at the distal end of the assembly. It is understood that the end of line 13 is blocked in the area just discussed to prevent leakage of water.

Figure 2:
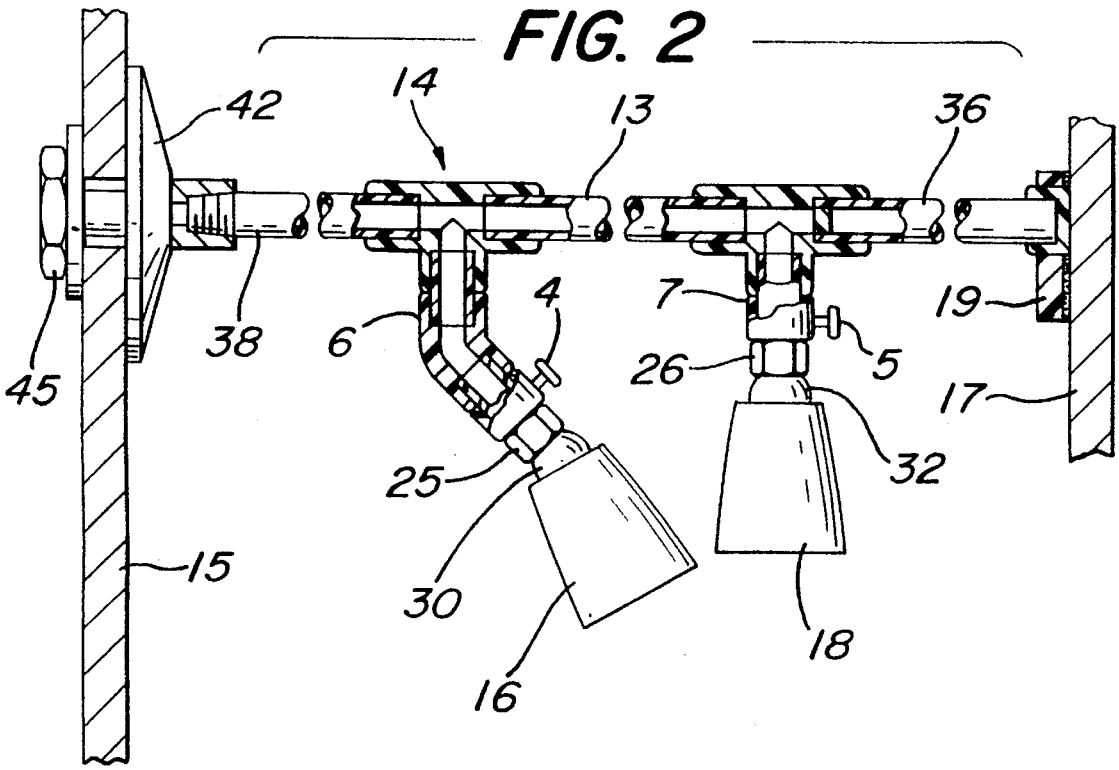
FIG. 2 is a sectional view of two T-fittings which are connected to a supply line and further illustrating the angles of the two shower head extensions.

In the preferred embodiment, the proximal head 16 and the distal head 18 are directly attached to the supply line 50 via straight line extensions 20 and 22. This apparatus will be discussed in greater detail hereinafter. In another embodiment, the heads 16 and 18 are attached to a supply line 13 via respective extensions 6 and 7 which are shown in FIG. 2 as T-fittings. The extensions 6 and 7 are joined to the line 13 which may be made of polyvinyl chloride (PVC) by an appropriate bonding medium. Other suitable materials may be utilized without departing from the spirit of this invention. The proximal T-fitting extension 6 is inclined to the horizontal at an acute angle after a short vertical transition; on the other hand, the distal extension 7 is a T-fitting that is oriented in a downward direction. The dual heads 16 and 18 are attached to the respective extensions 6 and 7 by nuts 25 and 26 and appropriate washers which are joined to threaded terminal members (not shown), and are further joined to ball joints 30 and 32, which enable a user to swivel the heads to develop a water spray pattern that is required for an adult or child in accordance with the principles set forth in this invention. Shut-off valves 4 and 5 are provided to allow individual control of each head in conjunction with main valve 90 (see FIG. 1).

The swivel heads 16 and 18 are arranged such that distal head 18 is swivable about the vertical extension 7 with a 360° rotation, whereas proximal head 16 is rotatable in the same manner about the inclined extension 6. This rotatable head and extension configuration allows a spray pattern to be formed upon either an adult or child user which covers the skin in a manner that prevents chilling upon the body particularly during seasons where cold drafts are prevalent in a residence. The spray pattern for an adult in achieving the above stated benefit is attained by standing between the heads 16 and 18.

When an adult is located under the shower assembly 14, proximal head 16 is aimed to generate a spray that strikes under the user's chin; and, the distal head 18 is aimed to generate a spray which impinges upon the back of the head at or above the neckline. This simultaneous spraying action from a warm water source produces a pattern upon the anatomy at or above the neckline to the feet that is comforting as well as soothing in view of the warmth that is produced over the impacted skin surface. The vertical and inclined orientation of extensions 6 and 7 in combination with swivel heads 16 and 18 allows the user to stand between heads 16 and 18 and to direct the spray by hand to any part of the anatomy without the user having to move his or her feet. This reduces a possibility of the user slipping and falling. In the event that a child is a user of the device shown in FIGS. 1 and 2, the orientation of dual heads 16 and 18 is readjusted from the adult positioning to achieve similar results and to avoid a direct contact with the child's face which can cause discomforture and displeasure to the child.

The assembly 14 of FIG. 2 may be easily constructed so that a state-of-the-art single head shower as is found in most homes may be retro-fitted to a dual head design in accordance with the principles of the invention. In this embodiment, the extensions 6 and 7 are constructed in the form of T-fittings which are joined to the supply line 13 by suitable bonding. An extension member 36 is provided for coupling with the T-fitting extension 7 and block 19 is secured to wall 17 by fastening means (not shown) such as set screws, bolts or any other fastening means to fix block 19 firmly in place on wall 17.

The proximal end of the supply line 13 is fitted with a nipple 38 which is threaded at one end. The unthreaded end of nipple 38 is bonded to one end of the T-fitting extension 6 and, the threaded end is joined to the existing pressurized water source 45 behind wall 15. Nipple 38 slides through decorative bezel 42 which lays against wall 15. Thus, the assembly is tightly secured within the shower enclosure by being screwed into the pressurized water supply at the proximal end of the assembly and being mounted on block 19 which is securely attached to the wall 17 at the distal end of the assembly.

The embodiment of the invention previously mentioned with respect to FIG. 1 is more graphically illustrated in FIG. 3 and the specifications for the preferred embodiments are set forth below:

SPECIFICATIONS FOR DUAL HEAD ASSEMBLY

HEIGHT RANGE OF SUPPLY LINE: 78"–80"

APPROXIMATE HEIGHT RANGE OF USER: 30"–78"

APPROXIMATE HEIGHT OF SPRAY INTERSECTION: 20"–69"

SEPARATION RANGE (A→B): 26"–40"

ANGULAR RANGE OF PROXIMAL ACUTE PROJECTION: 40°–50°*

ANGULAR RANGE OF DISTAL VERTICAL PROJECTION*: 85°–95°*

ANGULAR RANGE OF PROXIMAL ACUTE HEAD*: 30°–60°

ANGULAR RANGE OF DISTAL VERTICAL HEAD*: +60°→–60°*

LENGTH RANGE OF PROJECTION (A→C): 3½"

LENGTH RANGE OF PROJECTION (B→D): 2"

*angles measure with respect to the horizontal.

The main body 50 of the supply line is designed to have a circular cross section although a rectangular cross section may be used in order to simplify its manufacture as well as to enhance its appearance. The height of the supply line is connected at a distance of 78–80 inches in order to accommodate a user up to about 78 inches in height. The extensions 22 and 20, which are 2 and 3.5 inches long between points B, D and A, C, respectively, are integrally formed with the supply line 50 and are oriented in a generally downward and acute direction. The broadest range of separation between the mid-points of extensions 20 and 22 indicated at locations A, B is 26–40 inches. A preferred range however is 31–38 inches and in the actual embodiment is 35 inches in a shower enclosure of 60 inches wide. In a shower enclosure of 48 inches in width, the extensions 20 and 22 are separated by 31 inches; similarly, in a 32 inch stall, the separation is 26 inches. Proximal extension 20 is acutely inclined within a range of 40°–50° to the horizontal supply line 50 and is physically attached thereto by cementing the entire abutting surface to the exterior surface of the line. In the preferred embodiment, the acute angle is 45°. An internal pipe 57 is located within inclined extension 20 and communicates with openings 58, 60 and is fixedly held in position by a mutually operative threading device 61. The internal pipe 57 may also be held in position with respect to supply pipe 50 by cementing with an epoxy like adhesive or other suitable cement.

Figure 3:
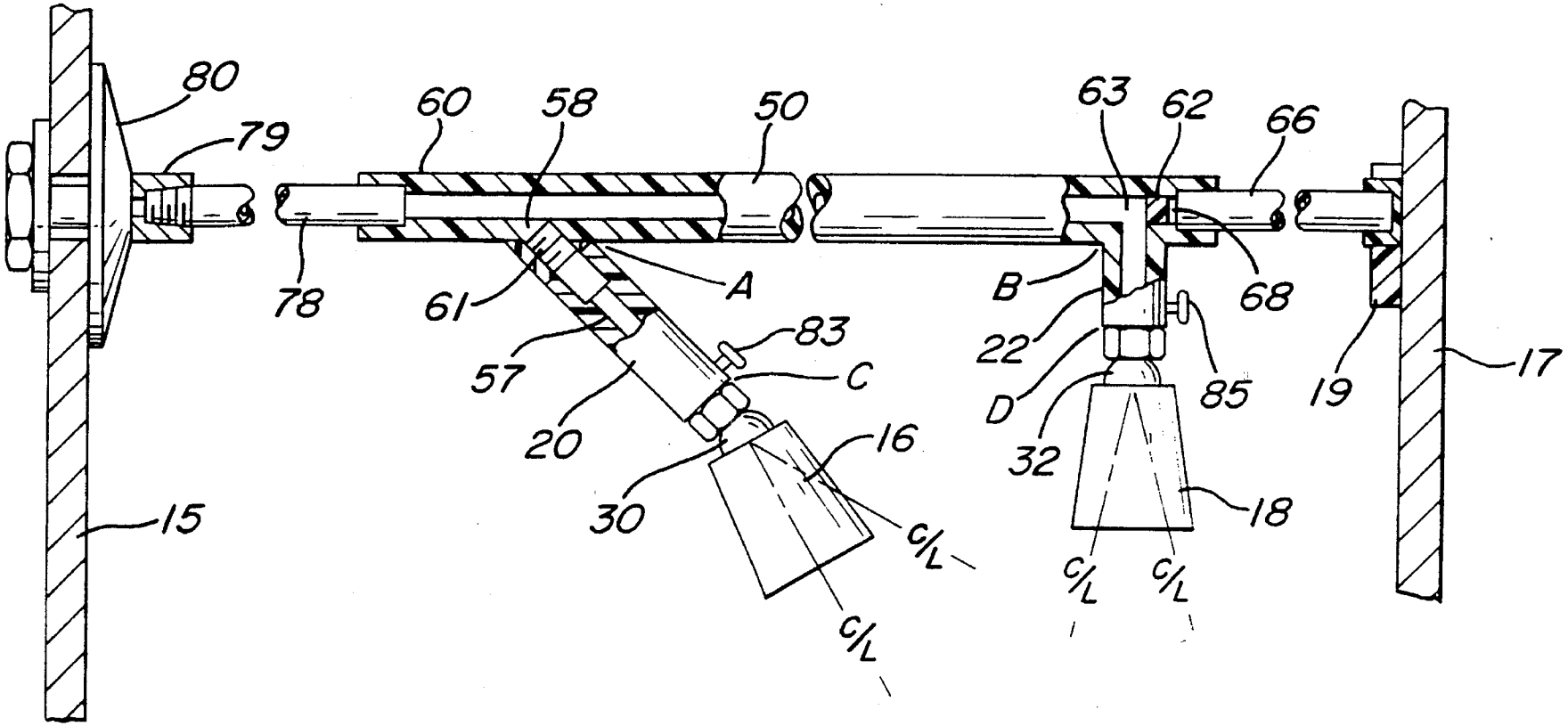
FIG. 3 is another embodiment of the invention wherein the extensions are differently formed with respect to FIG. 2.

The embodiment of FIG. 3 includes a blocking member 62 that terminates the pressurized water supply at distal end point 63 of opening 60. Contiguous to the block 62 is located a slidable shaft 66 one end of which is located within an opening 68; an opposite end of shaft 66 is coupled to a holder 19 which is attached to wall 17 by fastening means (not shown) such as set screws, bolts, or any other fastening means to fix block 19 firmly in place on wall 17. The slidable shaft 66 allows the shower assembly to be easily adjusted to accommodate variations in length when being installed and supported upon an opposite wall. The proximal end of line 50 is attached to a threaded nipple 78 one end of which is joined to the supply line 50 and, the opposing end is threaded into an existing pressurized water source 79 which is integrally joined to bezel 80. Sleeves (not shown) can be installed over shaft 66 and nipple 78 for decorative purposes. Thus, the assembly is tightly secured within the shower enclosure by being screwed into the pressurized water supply at the proximal end of the assembly and securely mounted to the wall opposite the source of pressurized water at the distal end of the assembly.

Individual shut-off valves 83 and 85 are also included which operate in conjunction with the main shut-off valves 90 (see FIG. 1). The valves 83 and 85 are useful for customizing the use of the dual shower heads 16 and 18 as well as for assisting parents when bathing children. The shut-off valves 83 and 85 are particularly useful in avoiding scalding of children since an adult supervisor can readily open valve 90 (see FIG. 1) to test the water temperature from spigot 91 prior to opening both valves 83 and 85.

Figure 6:
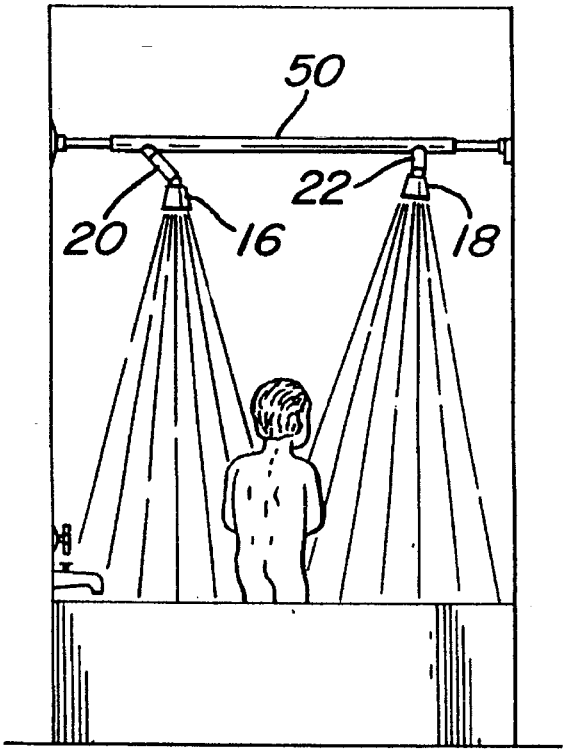
FIG. 6 is a view of a small child who is showering with the dual shower spray pattern that interacts at the neckline and below of the user.

Identical shower heads 16 and 18 which are respectively attached to the extensions 20 and 22 are swivable about ball joints 30 and 32. The distal head 18 is swiveled in another preferred embodiment between two defined limits of +75° and –75° as identified by the solid and dashed centerline (C/L) with respect to the 90° vertical. With respect to proximal head 16 which is attached to the extension 20, the two defined limits are approximately 60° as indicated by the solid centerline, and 30° as indicated by the dotted centerline. The arrangement of the proximal angular extension 20 and the distal vertical extension 22 define the angular swivel of the proximal head 16 and the distal head 18 to thereby enable a small child to be showered without striking the face as depicted in FIG. 6. When a child is struck by a full shower stream in the face, it causes discomfort and unhappiness with the result that crying and a request for removal often results. The system disclosed is also versatile in that by an adjustment of heads 16 and 18 enables an adult up to 78 inches in height is properly showered. The spray pattern emanating from heads 16 and 18 are conical in shape which, in effect, increases the angular ranges as set forth above.

An added advantage of a proximal angular extension combined with a distal vertical extension in the same shower unit is the maximization of water pressure and flow rate through the distal vertical extension shower head and the associated minimization of shower spray droop from the distal vertical extension shower head. Previous dual shower head devices utilized extensions which were angled toward each other. Water flowing through previous devices was thus forced to flow through an angle of greater than 90° in the distal shower head resulting in decreased flow rate and decreased water pressure in the distal shower head. The decreased flow rate and water pressure thereby caused the distal shower spray to droop, thus, providing a less invigorating shower to the shower user. Shower spray droop is defined as a non-linear, arcuate water droplet trajectory during water droplets falling from a shower head to a shower floor caused by gravitational forces acting on the water droplets in the shower spray. In general, water droplets which exit a shower head at a high velocity have flatter trajectories and less droop than water droplets which exit a shower head at low velocity.

Figure 4:
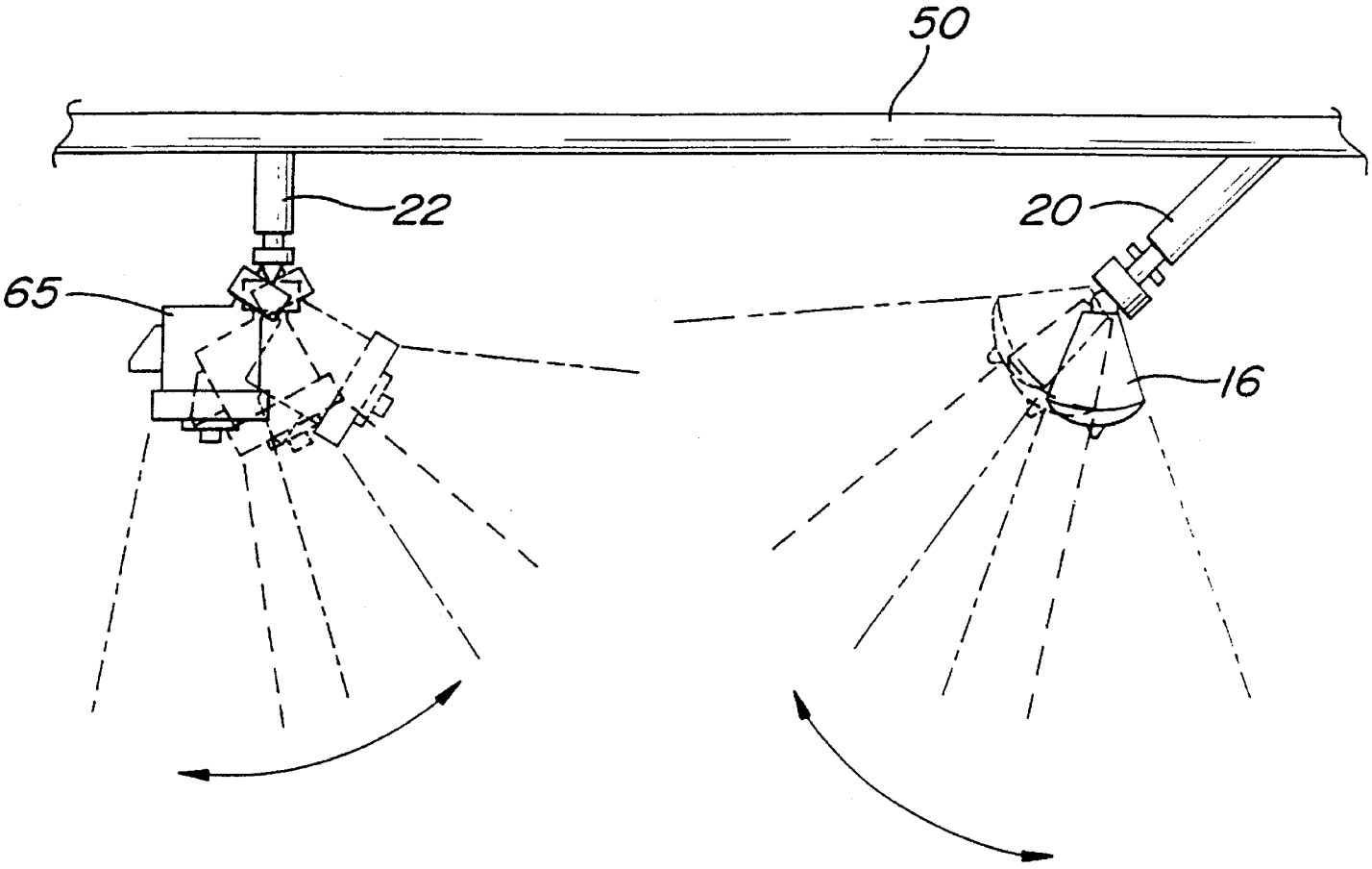
FIG. 4 illustrates some of the various angles that can be obtained in a preferred embodiment to obtain the desired results described herein.

In the preferred embodiment, the shower assembly of the invention is illustrated in FIG. 4 wherein the proximal and distal extensions 20 and 22 are approximately 3.5 and 2 inches, respectively in the manner set forth in FIG. 3. The angular range of the proximal acute projection 20 is 40°–50° and in the embodiment illustrated is 45°. The distal vertical projection 22 is designed within a range of 85°–90°. In another preferred embodiment, there is attached to extension 20 a proximal shower head 16 which is identified as Interbath Model 28442 and whose angular range is 30°–60°. The distal shower head 65 is designed as an off-set model identified as Interbath 28400. Distal Head 65 is designed such that it is able to rotate through an angle of 360° wherein its angular range is in the range of +60° to −60°. FIG. 4, therefore, merely illustrates one-half of the rotation between 90° to +60°. It is the wide angular adjustability of distal head 65 in combination with the adjustability of proximal head 16 that enables the small child whose height is as short as 30 inches to be showered without receiving the full force of the spray pattern directly in the face.

Figure 5:
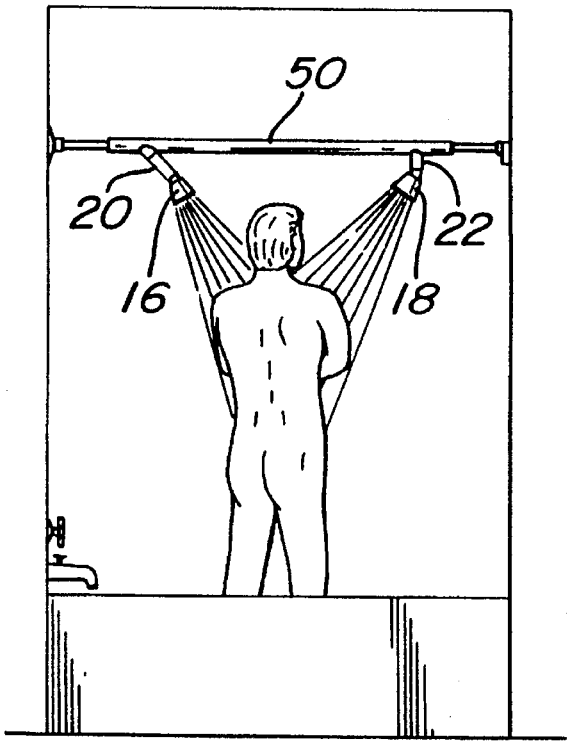
FIG. 5 is a view of an adult who is showering with the dual shower spray pattern that interacts at the neck line and below of the user.

The child depicted in FIG. 6 illustrates the basic principle of the invention, namely, that a diminutive person can be showered without receiving the direct force of the water droplets forming the shower spray in the face. Furthermore, in FIG. 5, an adult user is able to use the same device as illustrated by rotating proximal head 16 to the 30° or more and position the distal head 65 to +60°. The spray pattern of FIG. 6 is also capable of covering the anatomy of an adult or child so that the chill factor is eliminated. This is particularly the case when the ambient temperature is cool and relatively uncomfortable. This is accomplished by developing a water stream that continually transfer warmth to the various body parts which is achieved through proper rotation of the heads 16 and 18 with respect to the ball joint construction as well as the orientation of the extensions 6 and 7. The result is that the spray pattern envelops the body, be the user an adult or a child.

This invention has been described as a device in which discrete elements, such as a nipple, supply line, and extension component, may be combined to form a single assembly; however, it is to be understood that these elements may also be fabricated as a unitary piece by conventional means as, for example, by injection molding techniques without departing from the spirit and scope of this invention.

The assembly of this invention was tested against a known system and the results of this comparison are set forth in the following example.

EXAMPLE

Two inventions covered by U.S. Pat. No. 3,913,839 to Wilson and the assembly of the instant invention were mounted 79 inches above the test floor with a flat board mounted between the two shower heads of each device. The boards separating the spray patterns of each device had measuring indicia along each side of the boards' length to record the height of the uppermost and lowermost edges of each device's spray pattern to thereby determine the intersection point of the spray pattern of the proximal and distal shower heads of each device. The water pressure was maintained at 55 psig for each device.

In Wilson and Shorr, the fitting nearest the water supply is hereinafter referred to as the proximal end and the fitting furthest from the water supply is the distal end.

Figure 7:
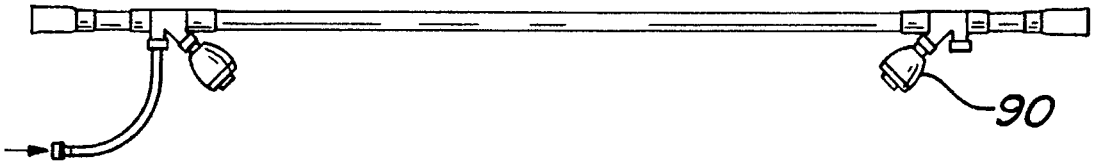
FIG. 7 PRIOR ART
FIG. 7 is a front elevational view of a prior art dual shower head device.
Figure 7A:
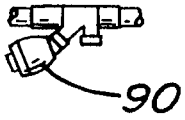
FIG. 7*a* is a partially cut-away view of the distal shower head shown in FIG. 7.
Figure 7B:
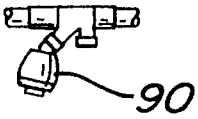
FIG. 7*b* is a partially cut-away view of the distal shower head shown in FIG. 7.

The Wilson "A" device was fitted with Ondine Model 28442 shower heads from Interbath on both shower head fittings and is illustrated in FIG. 7. FIGS. 7*a* and 7*b* illustrate the range of shower head positioning of the distal shower head 90 shown in FIG. 7.

Figure 8:
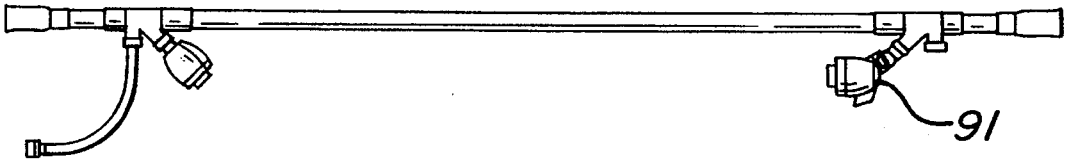
FIG. 8 PRIOR ART
FIG. 8 is a front elevational view of a prior art dual shower head device.
Figure 8A:
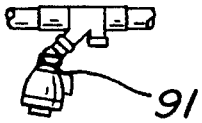
FIG. 8*a* is a partially cut-away view of the distal shower head shown in FIG. 8.

The Wilson "B" device was fitted with an Ondine Model 28442 shower head from Interbath on the proximal extension and an Ondine Model 28400 shower head from Interbath on the distal extension and is illustrated in FIG. 8. FIG. 8 illustrates the distal shower head 91 in the highest position for showering an adult and FIG. 8*a* illustrates the distal shower head 91 in the lowest position for showering a child.

Figure 9:
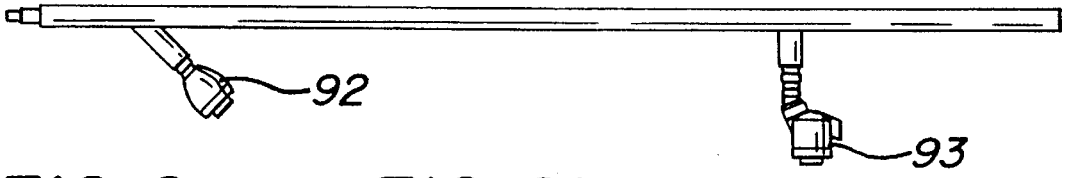
FIG. 9 is a front elevational view of the preferred embodiment of this invention.
Figure 9A:
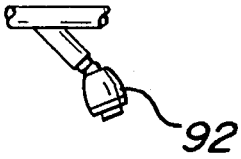
FIG. 9*a* is a partially cut-away view of the proximal shower head shown in FIG. 9.
Figure 9B:
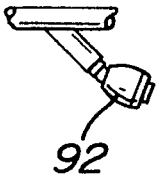
FIG. 9*b* is a partially cut-away view of the proximal shower head shown in FIG. 9.
Figure 9C:
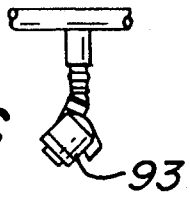
FIG. 9*c* is a partially cut-away view of the distal shower head shown in FIG. 9.

The assembly of this invention, that is, the Shorr device was fitted with an Ondine Model 28442 shower head from Interbath on the proximal extension and an Ondine Model 28400 shower head from Interbath on the distal vertical extension as illustrated in FIG. 9. FIGS. 9*a* and 9*b* illustrate the range of shower head positioning of the proximal shower head 92. FIG. 9*c* illustrates the distal shower head 93 in the highest position for showering an adult, and FIG. 9 illustrates the distal shower head 93 in the lowest position for showering a child.

The results are shown in the Table below:

| | Spray Pattern Intersection (inches) | | Flow Rate |
|---|---|---|---|
| | High | Low | (gallons/minute) |
| Wilson A | 73.0 | 36.0 | 4.3 |
| Wilson B | 72.0 | 47.5 | 4.0 |
| Shorr | 69.3 | 19.5 | 4.4 |

Figure 10:
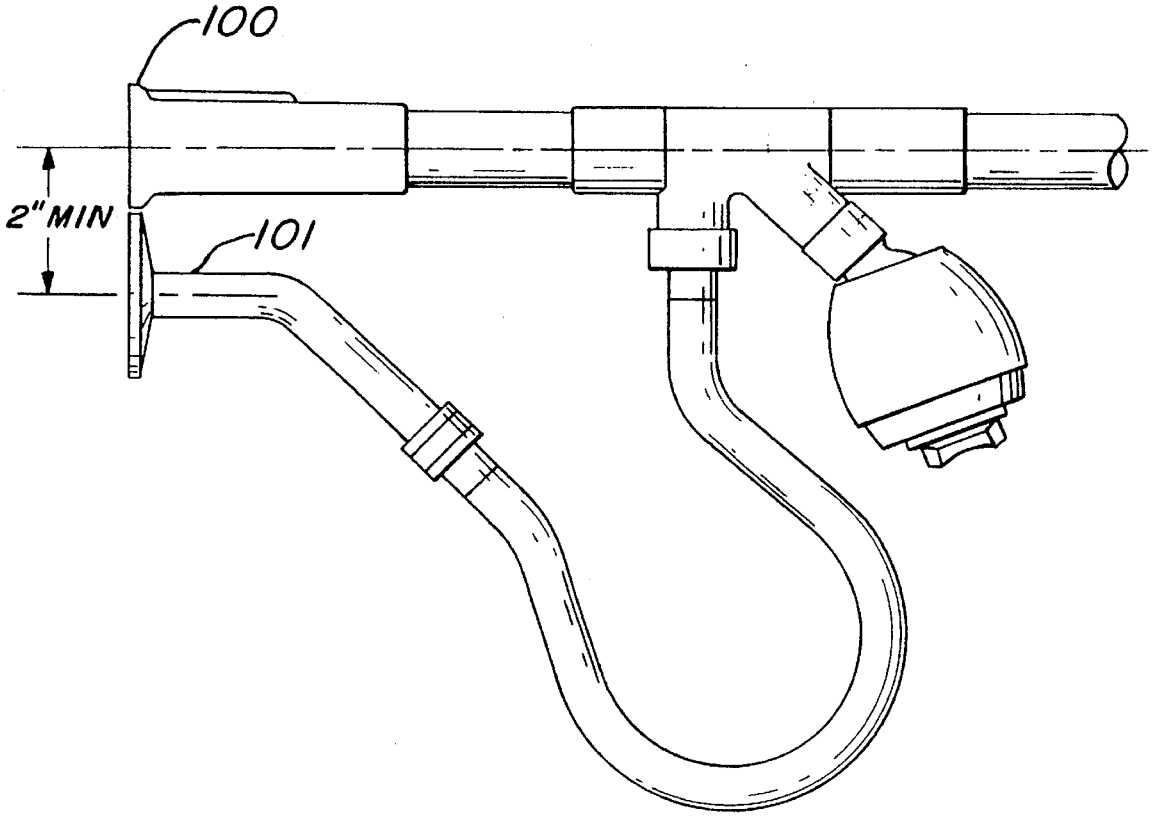
FIG. 10 PRIOR ART
FIG. 10 is a partially cut-away elevational view of a prior art dual shower head device.

The two Wilson device spray pattern intersection results were adjusted to compensate for how high above the shower floor a Wilson type device is mounted. Both the Shorr device and the Wilson devices were tested at the same height from the floor but, in reality, the Wilson device is not commonly mounted at the same height as the Shorr device due to the way in which the Wilson device attaches to the water supply. FIG. 10 illustrates the proximal end of a Wilson device and illustrates that the abutment member 100 is usually mounted at least two inches above the water supply outlet 101. Therefore, the spray pattern intersection results for the Wilson A and B. devices shown above were obtained by adding a two inch compensation factor to the Wilson test results to compensate for the difference in mounting between the Wilson and Shorr devices.

The tests show that, under similar conditions and compensating for the different mounting heights between the Wilson and the Shorr devices, the Wilson devices are capable of showering an adult whose chin line is as high as 73 inches but cannot shower a child whose chin is less than 36 inches tall. However, the Shorr device is capable of showering an adult whose chin line is as high as 69.3 inches as well as a child whose chin line is as low as 19.5 inches. Thus, the Shorr device has an improved range of spray intersection when compared to the Wilson devices.

Moreover, the Wilson A and B devices suffer from a flow rate decrease attributable in part to a water flow path which in Wilson requires water to flow through an angle of 130° through the distal extension as well as through restrictions within the distal shower head. By contrast, the instant invention provides a more direct path since water is made to flow through an angle of only 90° through the distal vertical extension as well as through restrictions in the distal shower head. Thus, the instant invention allows higher flow rates through the distal shower head than in the two Wilson devices tested. Therefore, the higher flow rates through the distal shower head of the instant Shorr invention results in improved shower spray pattern velocity over the Wilson device tested and minimization or elimination of perceived shower spray droop.

Thus, the invention provides a new and improved dual shower head assembly capable of providing dual shower sprays which intersect in the range of about 20 to about 69 inches above the shower floor enclosure, which is securely anchorable within a shower stall to prevent the assembly from sliding down the shower wall and which is attachable directly to the source of pressurized water to position the dual shower heads within reach of most device users.

This invention has been described by reference to precise embodiments, but it will be appreciated by those skilled in the art that this invention is subject to various modifications and to the extent that those modifications would be obvious to one of ordinary skill they are considered as being within the scope of the appended claims.

What is claimed is:

1. A shower assembly comprising, a.) a source of pressurized water in a shower enclosure having at least two opposing walls and a floor;

b.) a horizontal supply line having proximal and distal ends where the proximal end is connected directly opposite said source without any intervening member and, said distal end is securely fastened to an opposite wall such that when said supply line is directly connected to said source said line is fixedly oriented parallel to said floor;

c.) first and second tubular projections extending downwardly from and connected to said line, wherein said first projection is approximately 3.5 inches in length and said second projection is approximately 2 inches in length, d. said first projection extending downwardly at an acute angle within a range of 40°–50° from said line and, said second projection extending downwardly approximately perpendicular to said floor, e.) said second projection providing a flow rate for said pressurized water to minimize shower spray droop; and f.) said first and second downward projections being separated from each other at the supply line and their respective mid-points in a range of 26–40 inches;

g.) first and second shower heads respectively and fixedly attached to the end of said projections wherein each head is swivable within a designated range, and the flow rate to said shower assembly from said source being approximately 4.4 gallons per minute;

h.) said first and second heads being adjustable to an angle within said respective ranges to provide an intersecting conical spray pattern in a range of about 20–69 inches above said floor, i.) whereby an adult or child positioned approximately intermediate the two heads is able to shower without receiving a chill and without being sprayed in the face by pressurized water droplets from said spray pattern.

2. A shower assembly of claim 1 wherein said intersecting spray pattern is located as low as 19.5 inches above said floor.

3. A shower assembly of claim 1 wherein said intersecting spray pattern is located in a range of about 19.5–35.9 inches above said floor.

4. A shower assembly in accordance with claim 1 wherein said first head is swivable upon said first projection within a designated range of 30°–60°.

5. A shower assembly in accordance with claim 1 wherein said second head is swivable upon said second projection within a designated range of 120°.

6. A shower assembly in accordance with claim 5 wherein said second head is off-set and is adjustable between +60° to –60°.

7. A shower assembly in accordance with claim 1 and further including, a recessed slot for locating on said opposite wall for providing support to the distal end of said supply line.

8. A shower assembly in accordance with claim 1 wherein said second head is swivable upon said second projection between limits of +75° and –75°.

9. A shower assembly in accordance with claim 1 wherein said first and second downward projections are separated from each other at the supply line in a range of 31–38 inches.

10. A shower assembly in accordance with claim 1 wherein said first and second projections are separated at the supply line by a distance of 35 inches.

11. A shower assembly in accordance with claim 1 wherein said supply line is located in a range of 78–80 inches above said floor.

12. A shower assembly having two heads positioned upon a horizontal supply line which is connected without any intervening member directly to a pressurized water source emanating out of a wall and securely connected to an opposite support wall above a floor, the improvement comprising, a.) a first projection emanating downwardly from and connected to said supply line at an acute angle in the range of 40°–50°;

b.) a second projection emanating downwardly from and connected to said supply line in a range of 85°–95°, c.) said first and second projections being separated from one another at the supply line by a distance whose range is between 31–38 inches and wherein said first projection is approximately 3.5 inches in length and wherein said second projection is approximately 2 inches in length;

d.) first and second swivable shower heads fixedly attached to said respective first and second projections, wherein each head is swivable within a designated range;

e.) said first and second heads being adjustable to an angle within said respective ranges to provide an intersecting and high pressure conical spray pattern in a range of about 20–69 inches above said floor, f.) the flow rate to said shower assembly from said source being approximately 4.4 gallons per minute;

g.) whereby an adult or, alternatively, a child standing approximately intermediate the two heads is able shower without receiving a chill and without being sprayed in the face by said high pressure spray pattern.

13. A shower assembly having two heads positioned upon a horizontal supply line which is connected directly to a pressurized water source emanating out of a wall and securely connected to an opposite support wall, the improvement comprising, a.) a first projection emanating downwardly from and connected to said supply line at an acute angle of 45°;

b.) a second projection emanating downwardly from and connected to said supply line at approximately a vertical angle;

c.) said angled projections providing a flow rate for said pressurized water from the source to minimize shower spray droop, and d.) the flow rate to said shower assembly from said source being approximately 4.4 gallons per minute;

e.) said first and second projections being separated by a distance in the range of 26–40 inches and wherein said first projection is approximately 3.5 inches in length and wherein said second projection is approximately 2 inches in length;

f.) first and second swivable shower heads fixedly attached to said respective first and second projections;

g.) said first and second shower heads having a range of swivability so that a centerline through the first shower head varies between a range of 30°–60° and a centerline through the second shower head varies between a range of +75° to −75°, and h.) an intersecting conical spray pattern being produced by said adjustable shower heads to provide an intersecting spray pattern in a range of about 20–69 inches above said floor, i.) whereby a comfortable temperature is substantially produced over said adult or small child's skin surface when standing approximately intermediate said heads by eliminate chilling and continual turning when the water from said source is relatively warm, and further, j.) eliminating pressurized water droplets in the faces of a user by said spray pattern.

14. A shower assembly in accordance with claim 13 wherein said first and second projections are separated by a distance of approximately 35 inches in a 60 inch wide shower enclosure.

15. A shower assembly in accordance with claim 13 wherein said first and second projections are separated by a distance of approximately 31 inches in a 48 inch wide shower enclosure.

16. A shower assembly in accordance with claim 13 wherein said first and second projections are separated by a distance of approximately 26 inches in a 32 inch wide shower stall.

17. A shower assembly in accordance with claim 13 wherein said second shower head is swivable through an angle of 120° via an off-set rotation means.

* * * * *